US006000325A

United States Patent [19]

Schwelling

[11] Patent Number: 6,000,325

[45] Date of Patent: Dec. 14, 1999

[54] WASTE PRESS WITH EJECTION DEVICE FOR BALES

[76] Inventor: Hermann Schwelling, Hartmannweg 5, 88682 Salem, Germany

[21] Appl. No.: 09/143,934

[22] Filed: Aug. 31, 1998

[30] Foreign Application Priority Data

Sep. 1, 1997 [DE] Germany ..... 197 38 060
Dec. 15, 1997 [DE] Germany ..... 197 55 644

[51] Int. Cl.[6] ..... B30B 9/30; B30B 15/32

[52] U.S. Cl. ..... 100/53; 100/218

[58] Field of Search ..... 100/53, 218, 255

[56] References Cited

U.S. PATENT DOCUMENTS

| | | | |
|---|---|---|---|
| 3,728,959 | 4/1973 | Fredrickson | 100/218 |
| 3,916,781 | 11/1975 | Cerniglia | 100/218 |
| 3,955,492 | 5/1976 | Topolay | 100/218 |
| 4,182,236 | 1/1980 | Greer | 100/218 |
| 4,232,599 | 11/1980 | Ulrich | 100/218 |
| 5,044,271 | 9/1991 | Robbins et al. | 100/218 |
| 5,390,593 | 2/1995 | Gustavsson | 100/218 |

FOREIGN PATENT DOCUMENTS

| | | | |
|---|---|---|---|
| 2630906 | 1/1978 | Germany | 100/218 |
| 2019773 | 11/1979 | United Kingdom | 100/218 |
| 2274806 | 8/1994 | United Kingdom | 100/218 |

*Primary Examiner*—Stephen F. Gerrity
*Attorney, Agent, or Firm*—Friedrich Kueffner

[57] ABSTRACT

A waste press with an ejection device in which at least one lifting plate is arranged on or in a bottom floor of a shaft formed by a press housing and at least one pull rod of the ejection device connected in an articulated manner to the lifting plate is arranged in the press area of the shaft on or in a rear wall. In addition, a coupling member is provided for at least temporarily connecting the pull rod and the press plate. The coupling member which temporarily transmits the movement of the pressing plate to the lifting plate of the ejection device is constructed as a connecting unit arranged on the outside of the rear wall of the press housing, wherein the connecting unit is controlled by mechanically acting guide arranged on the press housing and forming a part of the press housing, and wherein the connecting unit protrudes through a cutout formed in the rear wall and is forcibly pivotable in and out and acts temporarily on the pressing plate. In addition, the connecting unit is permanently connected in an articulated manner to the upper end of the pull rod. An adjusting device which can be actuated through the front door acts on the guide of the connecting unit.

11 Claims, 11 Drawing Sheets

N
8c
G
8
8a
10a
10
8b
8d
9e
Z1
9a
9d
9
7
Z
14
9c
16
R
15
10b
9b
M'
M
D
S2
U
V
C
E
S
S1
F
P
3d
5
4
6
12
13
3
3b
3c
2
B
3a

8c
N
G
MB
S2
8a
15
7
15
8b
9b
Y
6
4
9a
9c
13
12
0
E
14
S1
R
MB
M'
M
C
S
F
3
P
2

Z2
15
7
G
6
U
F
M
C
M'
3d
S2
10
8a
W
9a
3
A
3b
3c
2

N
G
S2
M
M'
15
U
C
C
V
22
6
21
25
21a
24
5a
13
12
E
23
S
18
P
3
18a
F
R
1
3b
3c
2
3a
B

G
15
S2
22
21
6
0
12
M
18
C
18a
3
F
2
3b
3c

G
15
15
22
6
21a
25
6
21
21
12
5
5
5
24
23a
23
3
18
23a
S2
3
18a
S1
R
B

WASTE PRESS WITH EJECTION DEVICE FOR BALES

BACKGROUND OF THE INVENTION

1. Field of the Invention

The present invention relates to a waste press with an ejection device in which at least one lifting plate is arranged on or in a bottom floor of a shaft formed by a press housing and at least one pull rod of the ejection device connected in an articulated manner to the lifting plate is arranged in the press area of the shaft on or in a rear wall. In addition, a coupling member is provided for at least temporarily connecting the pull rod and the press plate. The waste press is used for pressing cartons, foils and similar used packaging materials into bales.

2. Description of the Related Art

Already known in the art are waste presses with an ejection device which have in the bottom area of the shaft of the press a lifting plate which can be pivoted toward the door opening. In these waste presses, the drive unit for the lifting movement for pivoting the lifting plate is arranged on the outside at the rear wall of the press housing. The structural elements for connecting the lifting plate to the drive unit extend outwardly through a slot or through slots provided in the rear wall of the press housing and extending down into the pressing area, as disclosed in U.S. Pat. No. 4,311,092.

These types of ejection devices are expensive and require a lot of maintenance because of the hydraulic system and the safety circuits in the control program to be provided additionally. Also, through the slots extending down to the pressing area, the materials to be pressed may travel to the outside, or clogging of the slot frequently leads to damage which reduces an effective utilization of the press.

In other types of ejection devices, for example, as disclosed in U.S. Pat. No. 4,182,236, ropes anchored in the floor area of the shaft at the front door stop edge are guided through the slots in the rear wall and are individually manually connected to the rear wall for achieving a position of rest. For preparing for the work step of ejecting bales, hooks connected to the ends of the ropes are guided through the slots in the rear wall and hooked into holes of the pressing plate. When the pressing plate which up to now has acted on the bale is moved upwardly, the ropes are tensioned in the direction toward the door opening and eject the finished bale.

In this type of configuration, the pressed material acting on the bottom side of the pressing plate makes it difficult to guide the hooks of the ropes into the holes of the pressing plate. Moreover, when preparing for the next pressing procedure, additional manipulations are required for placing the ropes in the described position. Furthermore, safety circuits are also in this solution required in the control program, so that the ejection device cannot be actuated with the front door being closed, which would lead to significant damage of the press.

Therefore, the applicant has in the past provided, inter alia, ejection devices in baling presses which were provided with a lifting plate at the bottom side, a pull means, preferably a pull rod, which is connected in an articulated manner to the lifting plate and is essentially vertically moveable in the shaft of the press in or at the rear wall thereof, wherein a pivotable or slidable catch member arranged in the area of the rear wall and on the upper side of the pressing plate can be hooked manually at the upper end of the pull means into an eye only after the front door has been opened. Any pressed packaging material lodged between the pressing plate and the rear wall makes it difficult to hook in the catch member. In addition, when actuating the catch member with the pressing plate being in the position in which it is placed on the bale, the operator of the press must reach over the pressing plate and laterally past the pressing die connected to the pressing plate, which means that the operator usually is with his upper body in the shaft of the press. Consequently, safety circuits in the control program must absolutely prevent an unintentional actuation of the pressing plates during this work step. Subsequently, during the subsequent upward movement of the pressing plate, the catch member takes up the pull means, preferably the pull rod, and the lifting plate at the bottom is tilted in the direction toward the released door opening for ejecting the finished and tied bale. For preparing for the next pressing procedure, the pressing plate must initially be moved into the lower position for switching off the ejection device and must then again be moved upwardly.

SUMMARY OF THE INVENTION

Therefore, it is the primary object of the present invention to provide a waste press with ejection device for bales in which the above-described disadvantages are essentially avoided and which is structurally robust, not susceptible to trouble and inexpensive, and ensures additional improvements of the working conditions of the operator.

In accordance with the present invention, the coupling member which temporarily transmits the movement of the pressing plate to the lifting plate of the ejection device is constructed as a connecting unit arranged on the outside of the rear wall of the press housing, wherein the connecting unit is controlled by mechanically acting guide means arranged on the press housing and forming a part of the press housing, and wherein the connecting unit protrudes through a cutout formed in the rear wall and is forcibly pivotable in and out and acts temporarily on the pressing plate. In addition, the connecting unit is permanently connected in an articulated manner to the upper end of the pull rod. An adjusting means which can be actuated through the front door acts on the guide means of the connecting unit.

Accordingly, the present invention provides for a mechanical forced coupling of the drive elements of the ejection device with the position of the front door closing the shaft of the press, for the automatic switching on of the ejection device when the pressing plate is moved upwardly after reaching the work position "bale ready", and for the automatic switching-off of the ejection device after the finished bale has been ejected and is placed in front of the open shaft of the press.

Another object of the present invention is to provide an even simpler construction of a waste press with bale ejection device which is even more structurally robust, less susceptible to trouble and less expensive, and in which further improvements of the work conditions for the operating personnel are provided.

In accordance with the present invention, this further improvement is achieved by constructing the mechanically acting guide means as a two-arm swing lever, wherein the inward and outward movements of the guide means can be controlled by a coupling rod of a push rod connected to a transverse locking member or connecting rod, a rear wall stop and guide tracks on the rear wall of the press.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
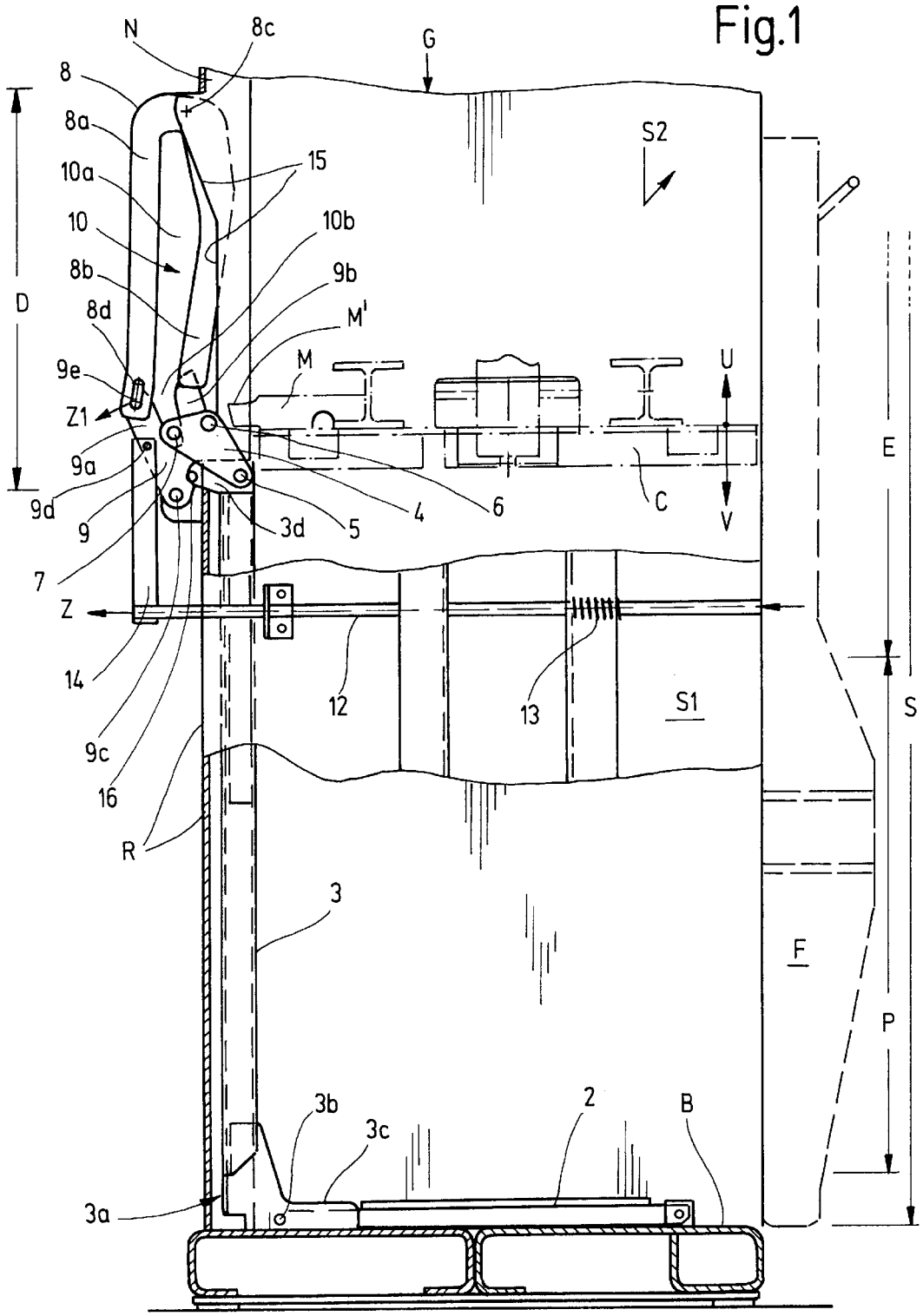
FIG. 1 is a side view, partially in section, of a waste press with the novel ejection device for bales, shown with the front door closed and the connecting unit swung out i.e., the position of rest.
Figure 2:
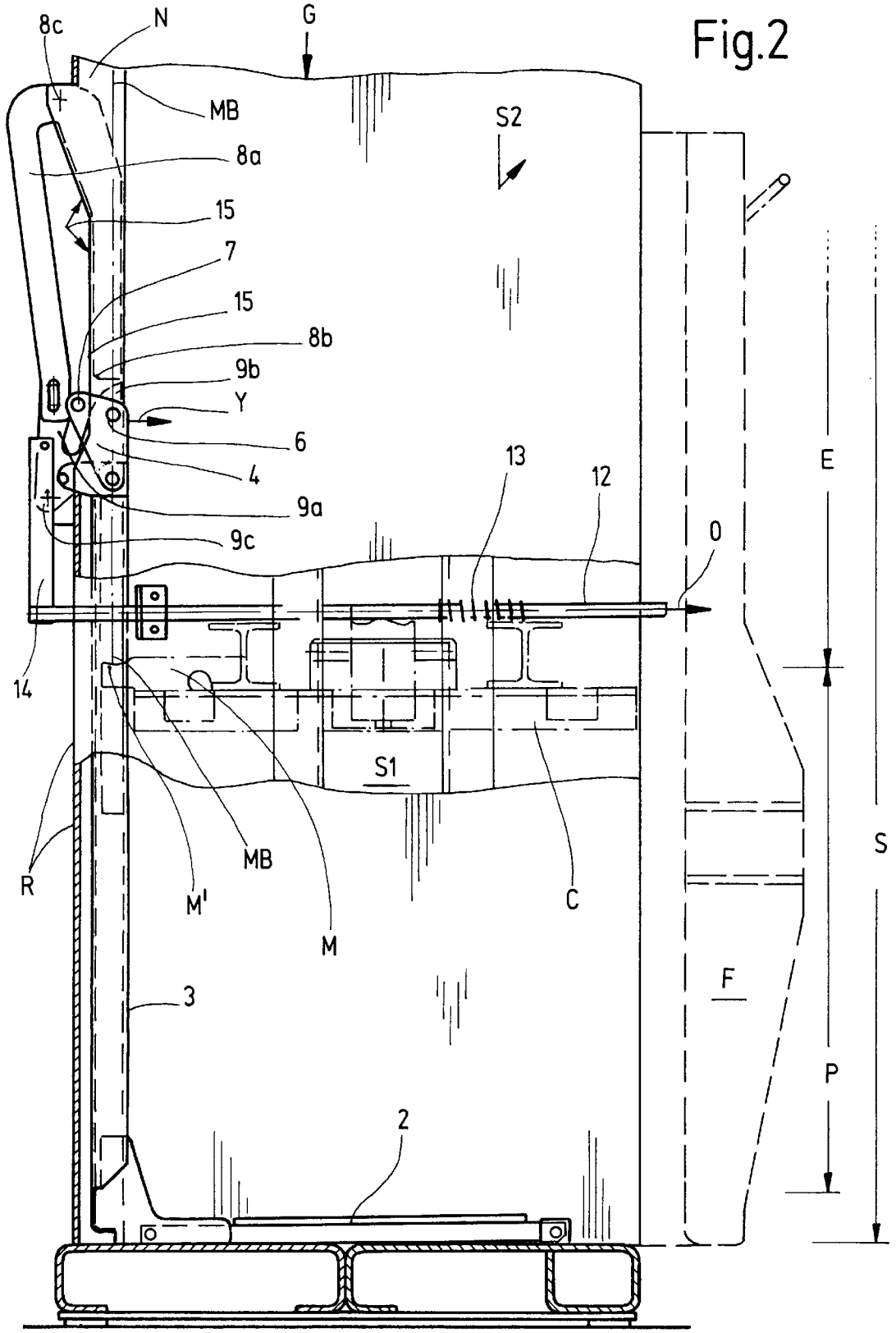
FIG. 2 is a side view similar to FIG. 1 showing the waste press with the front door opened and the connecting unit swung in and the pressing plate in the position "bale ready"
Figure 3:
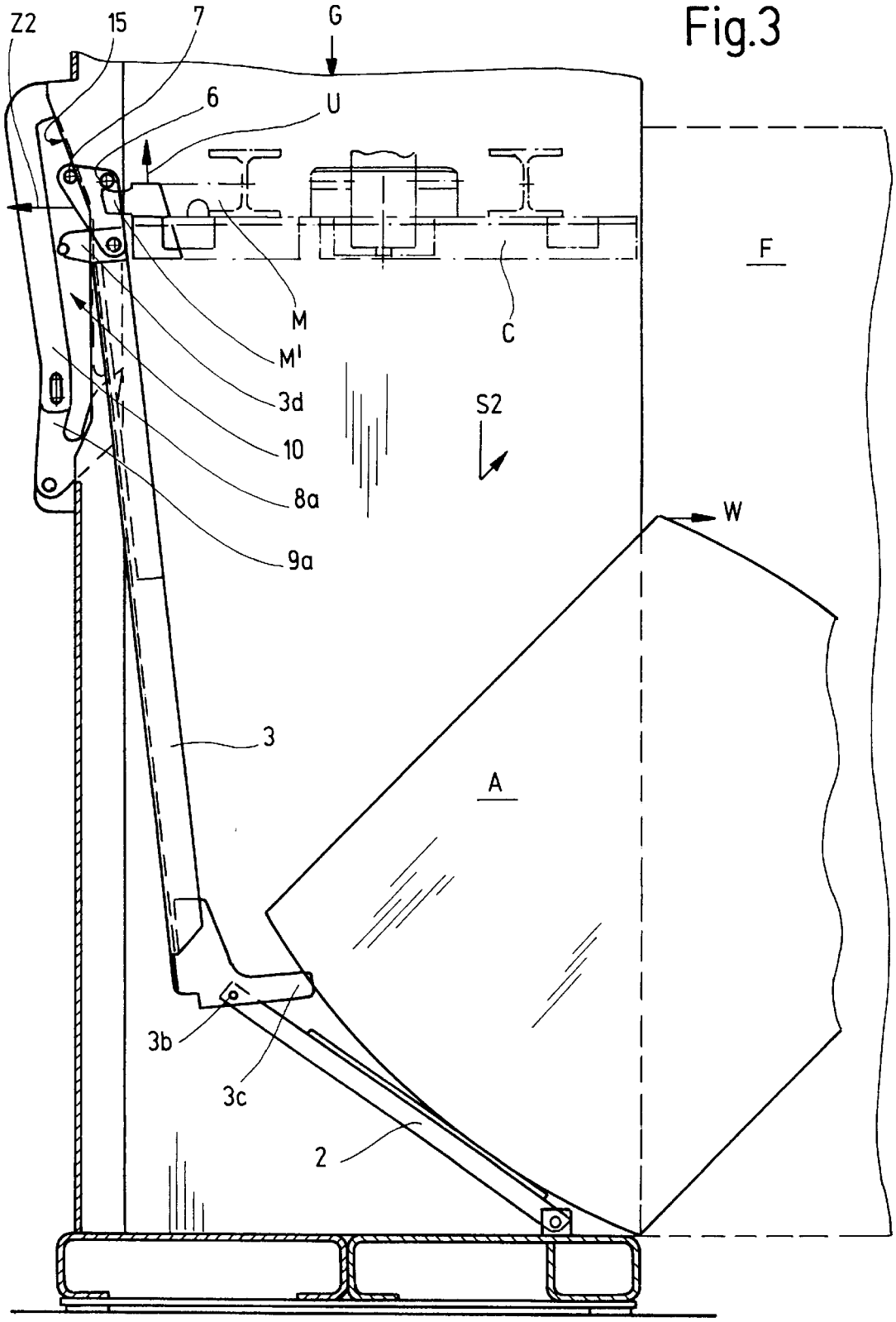
FIG. 3 is a side view similar to FIG. 1 showing the waste press with the front door opened and the connecting unit swung in and in the position "bale ejection"

FIGS. 1–3 of the drawing show an embodiment of a waste press which includes a press housing G, with a left side wall S1, a right side wall S2, a rear wall R, a front door F with integrated filling flap, and a bottom floor B, and a shaft S surrounded by the press housing and provided with at least one pressing area P and a filling area E located above the pressing area P. In this embodiment, a lifting plate 2 is arranged on the bottom floor B. Arranged in the pressing area P of the shaft S in the vertical groove N of the rear wall R extending to the bottom floor B is a pull rod 3 which is connected in an articulated manner through a hinge 3*b* to the lifting plate 2. In accordance with the novel embodiment according to the present invention, the upper end of the pull rod 3 extends into the filling area E and is equipped at this end with an outwardly protruding leg 3*d* and is secured against falling into the shaft by means of a rod 16 fastened to the leg 3*d*.

The coupling member which temporarily connects the pull rod 3 of the ejection device 1 to the pressing plate C and is conventionally mounted so as to be tiltable on the upper side of the pressing plate C is replaced in the embodiment according the present invention by the ejection device 1 shown in the drawing. This novel connection unit includes a swivel piece 4 which is connected in an articulated manner to a shaft 5 at the upper end of the pull rod 3 and is provided with a catch bolt 6 and a pressure bolt 7. The connecting unit further includes an upper U-shaped guide member 8 with preferably long sides 8*a* and 8*b* which form an upper portion 10*a*, and an also U-shaped lower guide member 9 with preferably short sides 9*a* and 9*b* which form a lower portion 10*b*, wherein the ends of the legs 8*a*, 8*b*, and 9*a*, 9*b* of the two guide members 8 and 9 face each other and form slightly overlapping a common closed, non-stationary guide unit 10 for the pressure bolt 7 fastened in the swivel piece 4. The guide members 8 and 9 are each supported in an articulated manner with a shaft 8*c* and 9*c*, respectively, on the outside of the rear wall R. In addition, for increasing the stability, the outer sides 8*a* and 9*a* can be equipped in the overlapping end areas thereof with inter-engaging pins 9*e* and oblong walls 8*d*.

Another significant feature of the present invention is the fact that an adjusting means capable of being actuated through the front door F acts on the guide means 8 and 9 of the connecting unit 4 to 10*b*. Specifically, a push rod 12 with compression spring 13 is guided on the left side wall S1 under the force of the spring and is connected by means of a strut 14 to the outer side 9*a* of the lower guide member 9. A pin 9*d* having a substantial thickness holds the outer side 9*a* to the strut 14.

FIG. 1 shows that when the front door F is closed the push rod 12 is engaged in the direction of arrow Z and the guide means 8 and 9 of the connecting unit of the ejection device 1 are held in the direction of arrow Z1 in the position of rest. In this position, the swivel piece 4 is pulled backwardly by the guided pressure bolt 7. The catch bolt 6 also provided on the swivel piece 4 is pivoted out of the groove N which vertically extends in the rear wall R. The pressing plate C is freely moveable in the shaft S in the directions of arrows U and V. The catch member M which is arranged on the upper side of the pressing plate C and whose end portion M' moves within the groove N travels past the catch bolt 6.

In the position in FIG. 2, the pressing plate C is in the position "bale ready" in the pressing area P. The front door F is opened and the push rod 12 moves in the direction of arrow 0 and causes the guide members 8 and 9 to be pushed in the direction toward the rear wall R, and the guided pressure bolt 7 simultaneously pivots the swivel piece 4 together with the catch bolt 6 in the direction of arrow Y through the cutout D in the rear wall R into the position "eject". The guide track 15 provided laterally of the cutout D and on the outside of the rear wall R limits the pivoting movement of the swivel piece 4 in such a way that the catch bolt 6 is located in the line of movement MB of the end portion M' of the catch member M located along the groove N.

FIG. 3 shows the work step "eject". The pressing plate C together with the catch member M travels upwardly in the direction of arrow U. The end portion M' of the catch member M engages underneath the catch bolt 6, so that the pull rod 3 including the lifting plate 2 are raised. The lifting plate 2 pivots toward the door opening and the bale A is ejected in the direction of arrow W from the pressing area P of the shaft S and is tilted onto a transport pallet, not shown, which has previously been positioned in front of the door opening.

In accordance with a special feature, the lower end of the pull rod 3 is equipped with a nose 3*c* extending horizontally and in the direction toward the lifting plate 2. This nose 3*c* significantly accelerates the ejection of the bale A.

The pressure bolt 7 which slides along the guide track 15 during the upward movement of the pressing plates C is pressed by the obliquely outwardly extending upper portion of the guide track 15 in the direction of arrow Z2 and simultaneously pulls the catch bolt 6 from the end portion M' of the catch member M and additionally presses the upper guide portion 8 together with the lower guide portion 9 toward the rear into the initial position Zl. The lifting plate 2 with the push rod 3 and the swivel piece 4 attached to the push rod 3 drop back downwardly into the initial position shown in FIG. 1, wherein the drop speed and the impact may be decelerated and damped by means of a damping element, preferably a gas pressure spring 18, connected to the pressure bolt 7, which acts on one of the components of the connecting unit.

Figure 4:
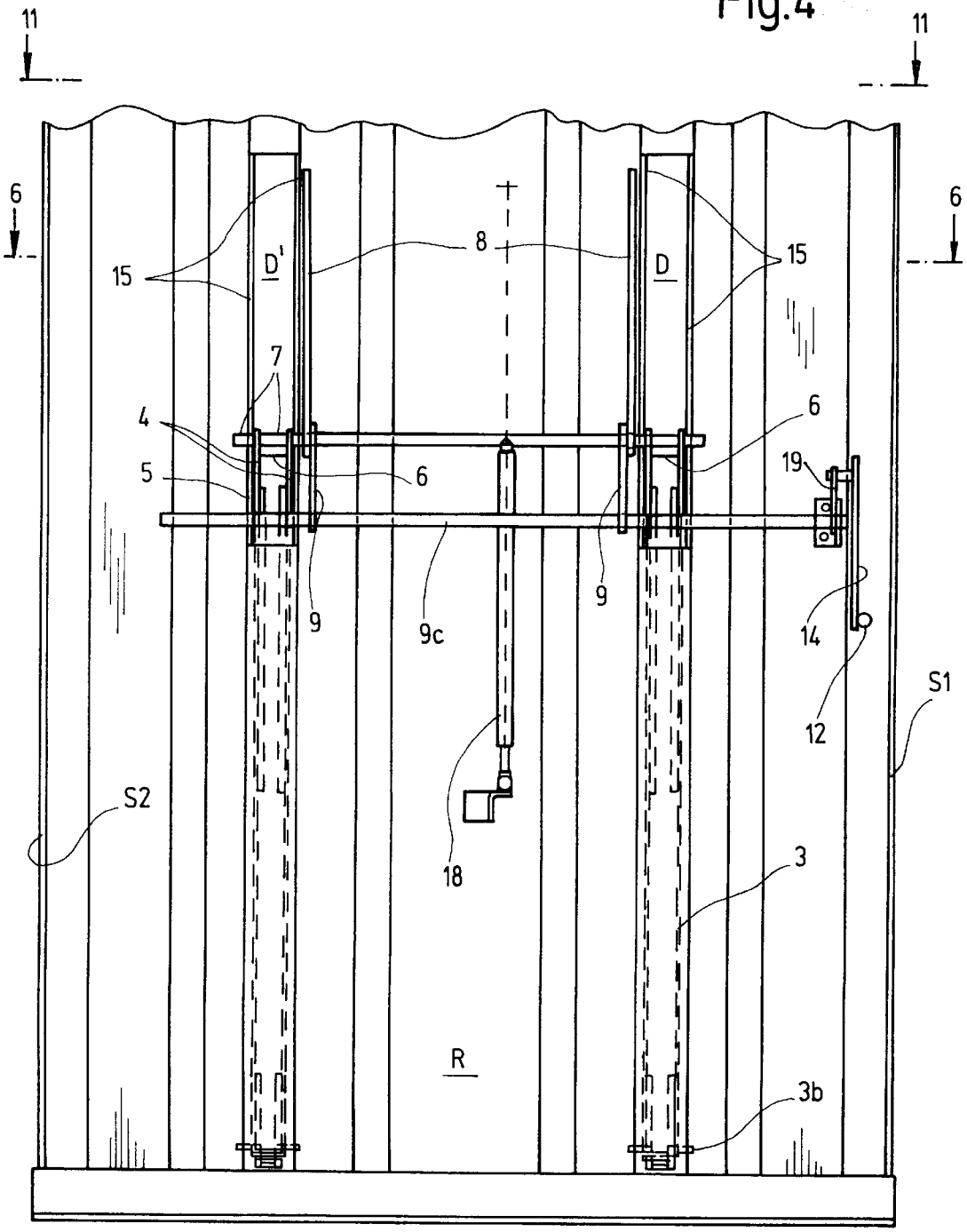
FIG. 4 is a rear view showing the rear wall of the press housing with another embodiment of the ejection device.
Figure 5:
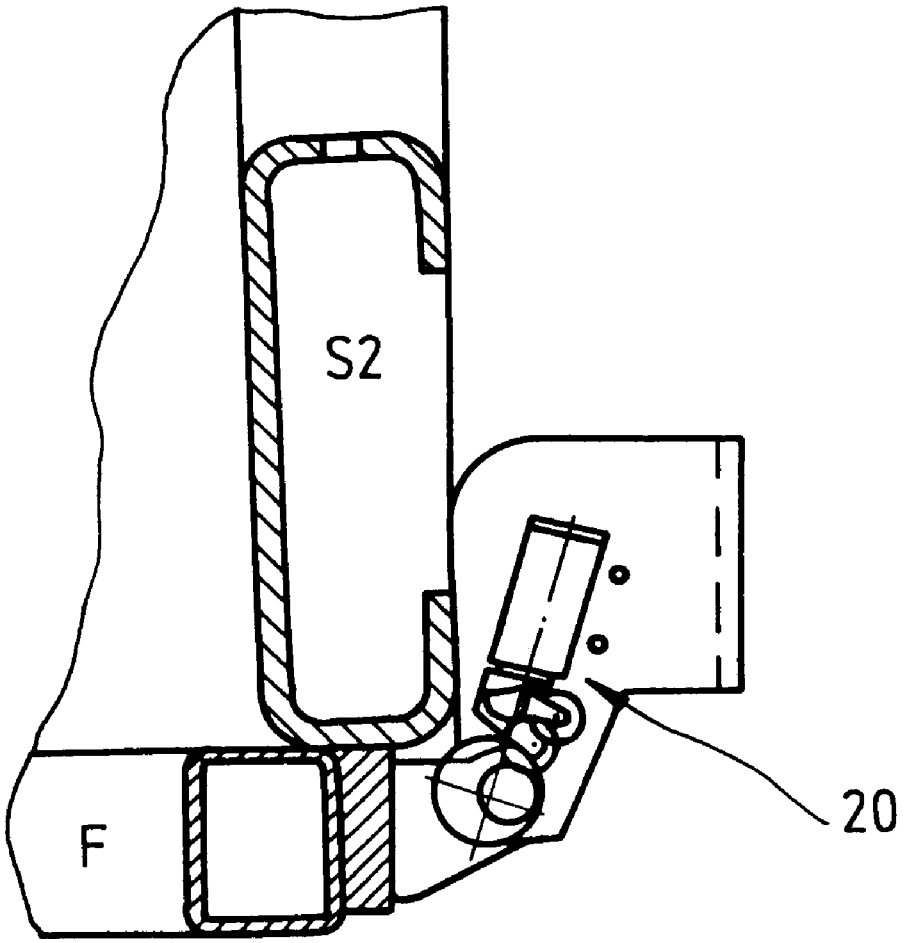
FIG. 5 shows as a detail a safety switch arranged in the range of movement of the front door.
Figure 6:
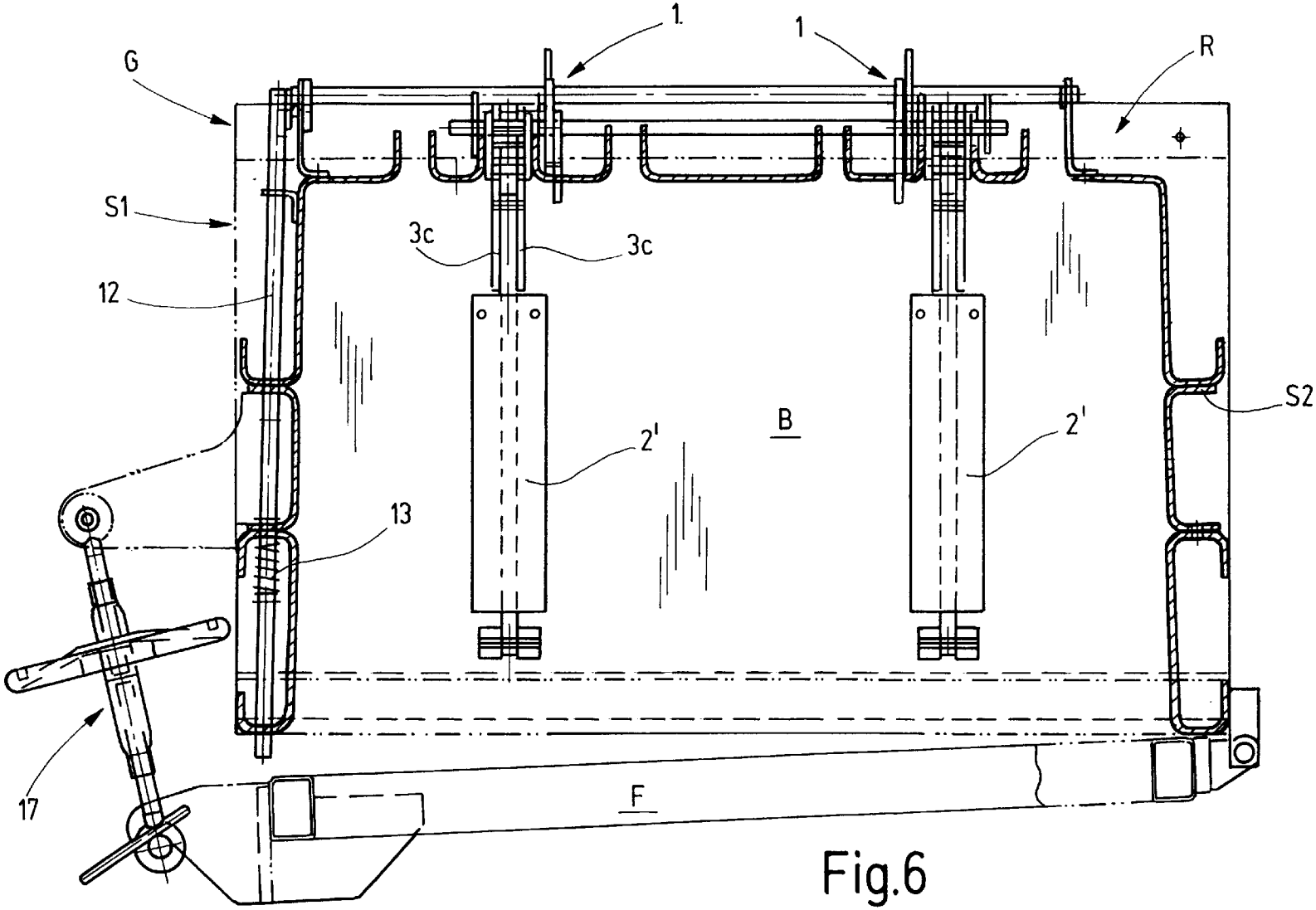
FIG. 6 is a top view into the shaft of the press equipped with an embodiment of the ejection device of FIG. 4.
Figure 7:
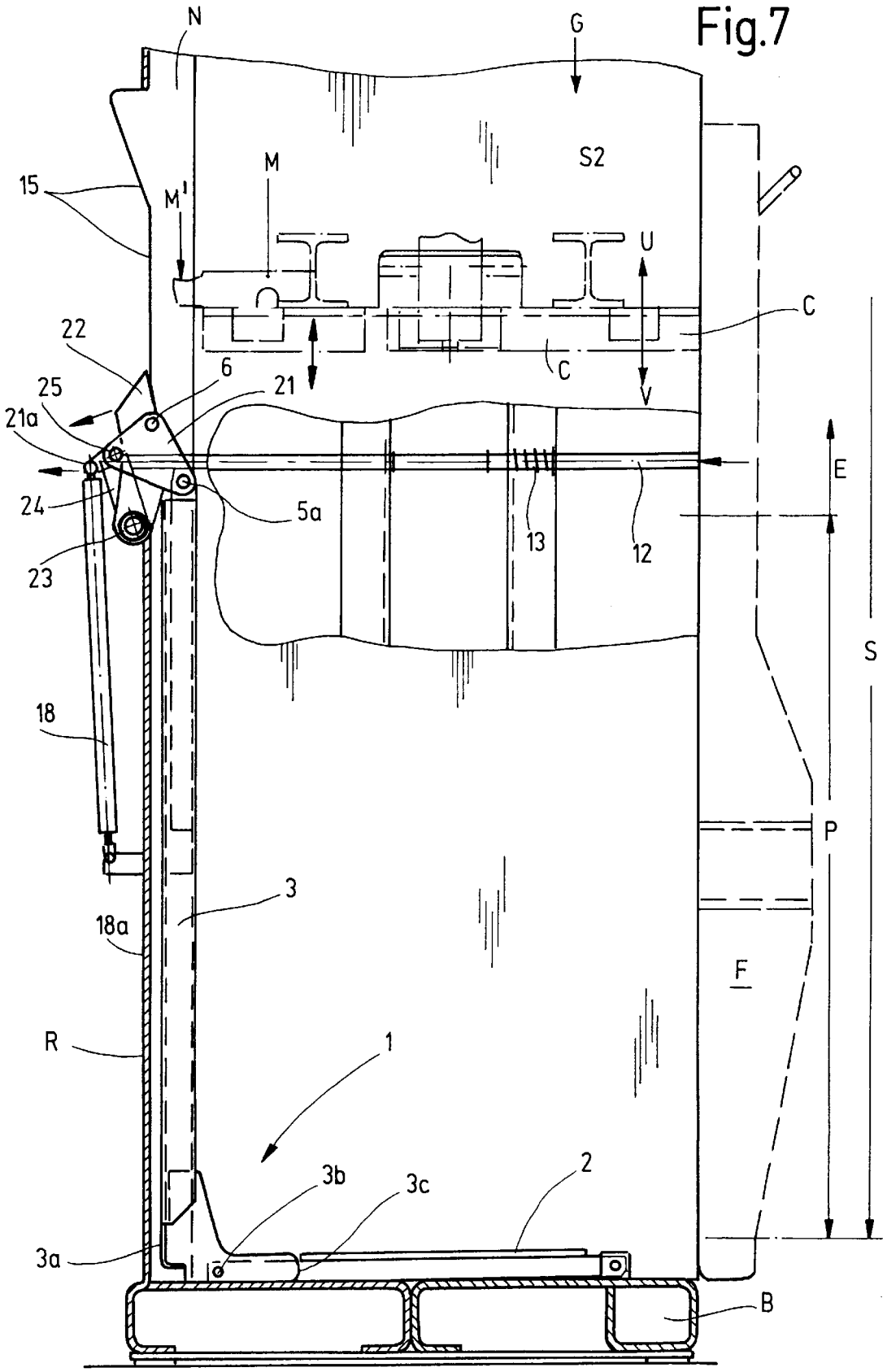
FIG. 7 is a side view similar to FIG. 1, showing another embodiment of the ejection device for bales.
Figure 8:
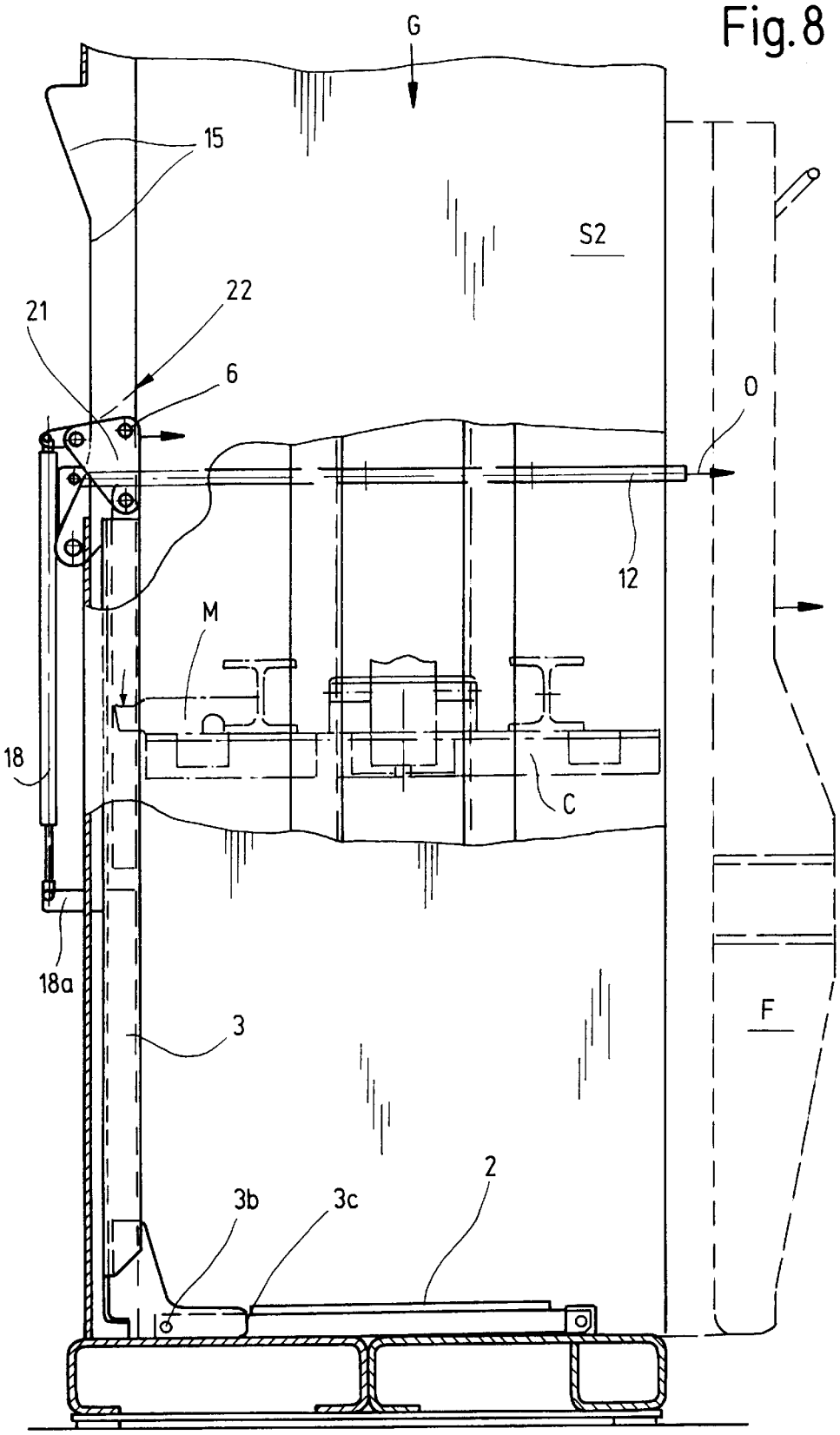
FIG. 8 is a side view similar to FIG. 7 showing the waste press with the front door opened and the connecting unit swung in and the pressing plate in the position "bale ready"
Figure 9:
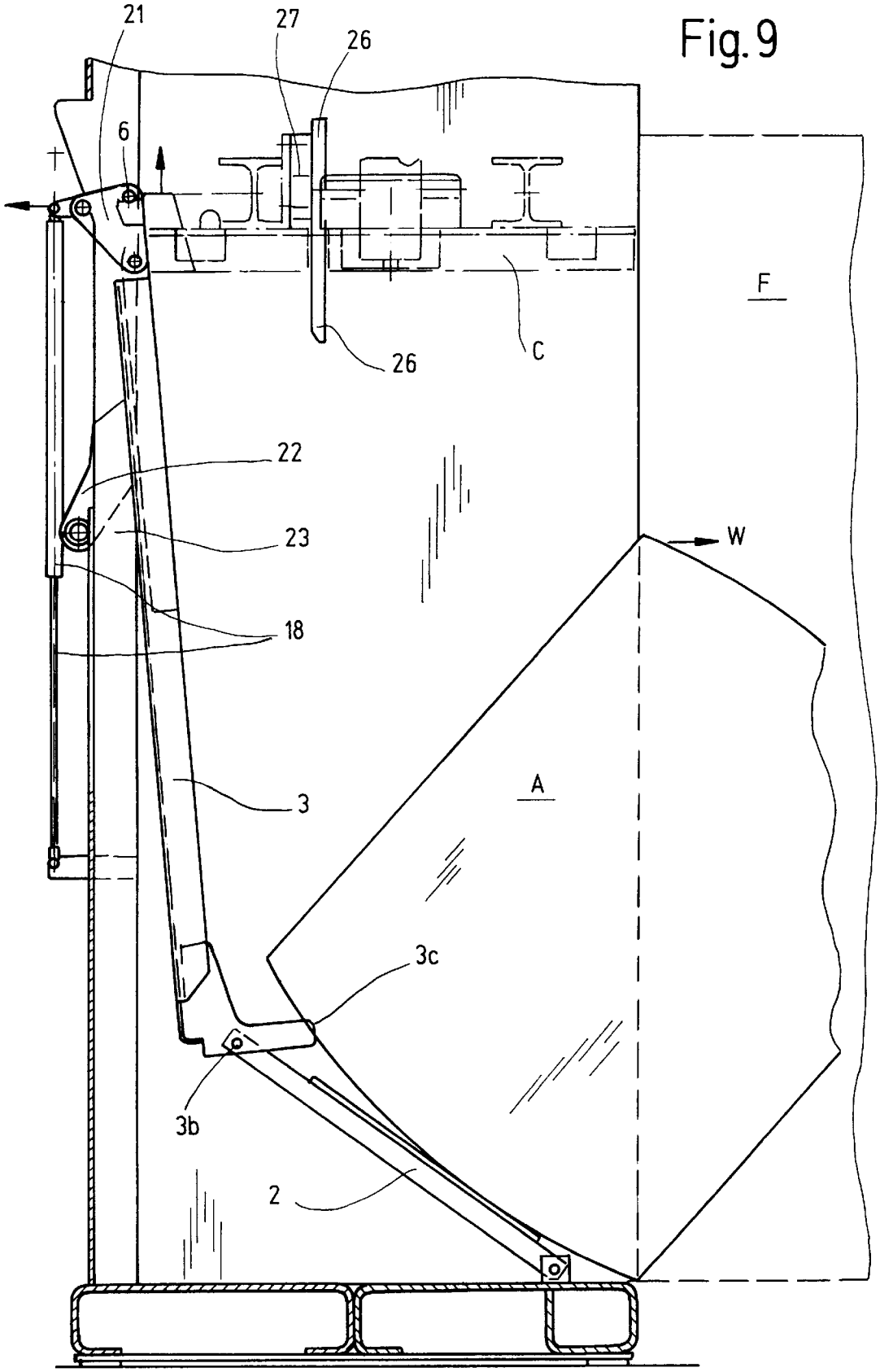
FIG. 9 is a side view similar to FIG. 7 showing the waste press with the front door opened and the connecting unit swung in and in the position "bale ejection"

FIGS. 4 and 6 show a modified embodiment of the press according to the present invention. The ejection device 1 is equipped with a plurality of small lifting plates 2 each of which is provided with a pull rod 3 and a connecting unit 4 to 10*b* arranged in the area of cutouts D to D', wherein the adjusting means 12 and 14 actuated from the front door F act by means of a lever 19 on a common shaft 9*c*, wherein the respectively lower guide members 9 are fixedly attached to the shaft 9*c*.

In accordance with a further development of the invention, the front door of the press housing G rests in the completely open position thereof against a safety switch 20, wherein this safety switch releases the switch for the lifting movement of the pressing plate, so that a release for effecting the work step "bale ejection" can only take place when the front door F is completely opened.

Another further development of the invention provides that the ejection device is always returned to its initial position when the door is completely closed or when the door is in the process of being closed, but at least prior to the downwardly directed movement of the pressing plate which follows the work step "bale ejection". This prevents components of the connecting unit 4 to 10*b* of the ejection device from colliding with the catch bolt 6 arranged on the pressing plate C.

In the embodiment of the ejection device according to the present invention shown in FIGS. 7 to 11, the relatively complicated linkages of the mechanically acting guide means of the embodiments described above is now replaced by a mechanically acting guide means in the form of a two-arm swing lever 21 and can be controlled with respect to its inward and outward movements through the coupling rod 23 of the push rod 12 in connection with a transverse locking member (connecting rod 25), the rear wall stop 22 and the guide tracks 15 on the rear wall R of the press. In principle, the ejection procedure takes place in this embodiment in the same way as in the embodiments described above.

Figure 10:
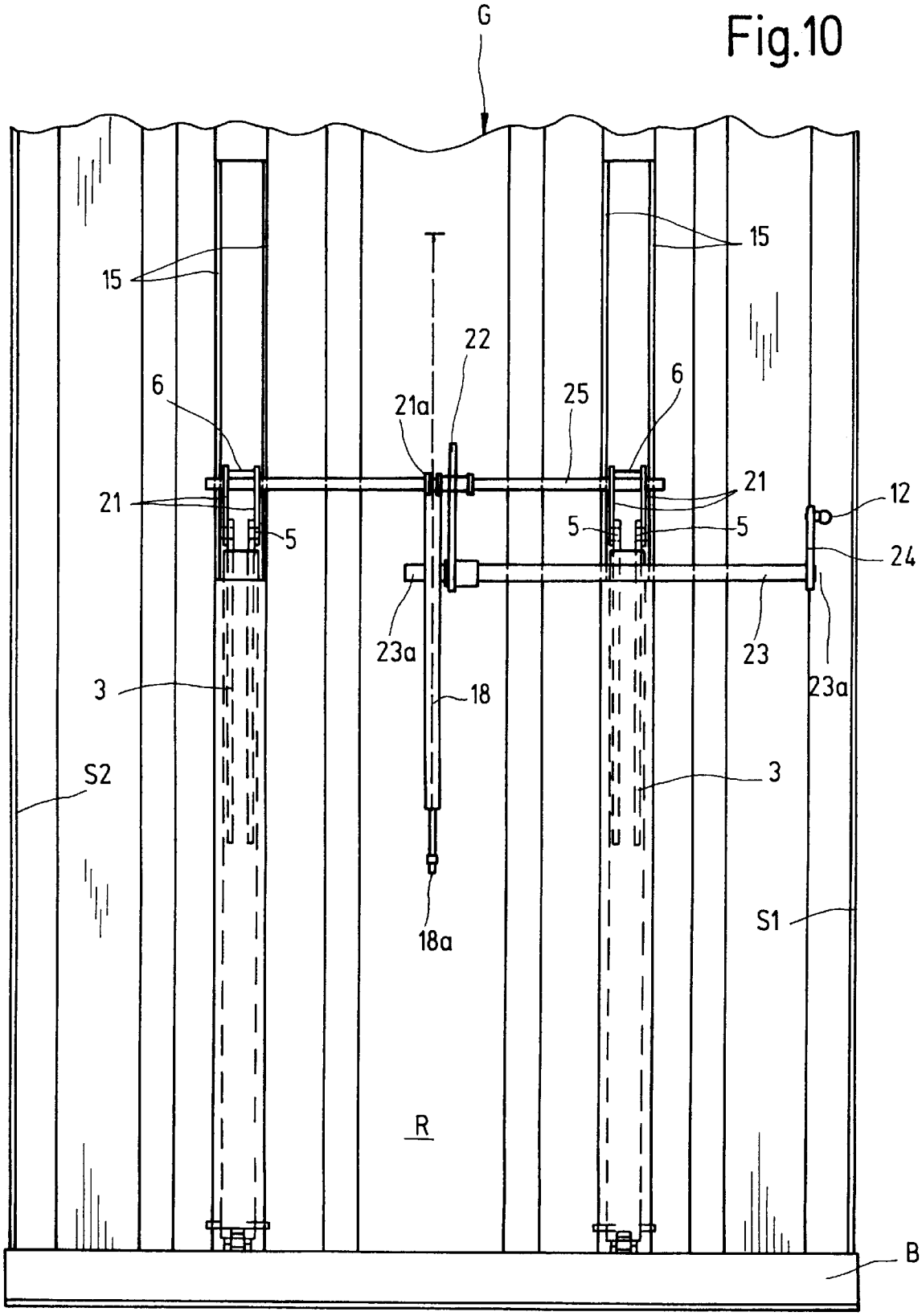
FIG. 10 is a rear view of the rear wall of the press housing of the press of FIG. 7.
Figure 11:
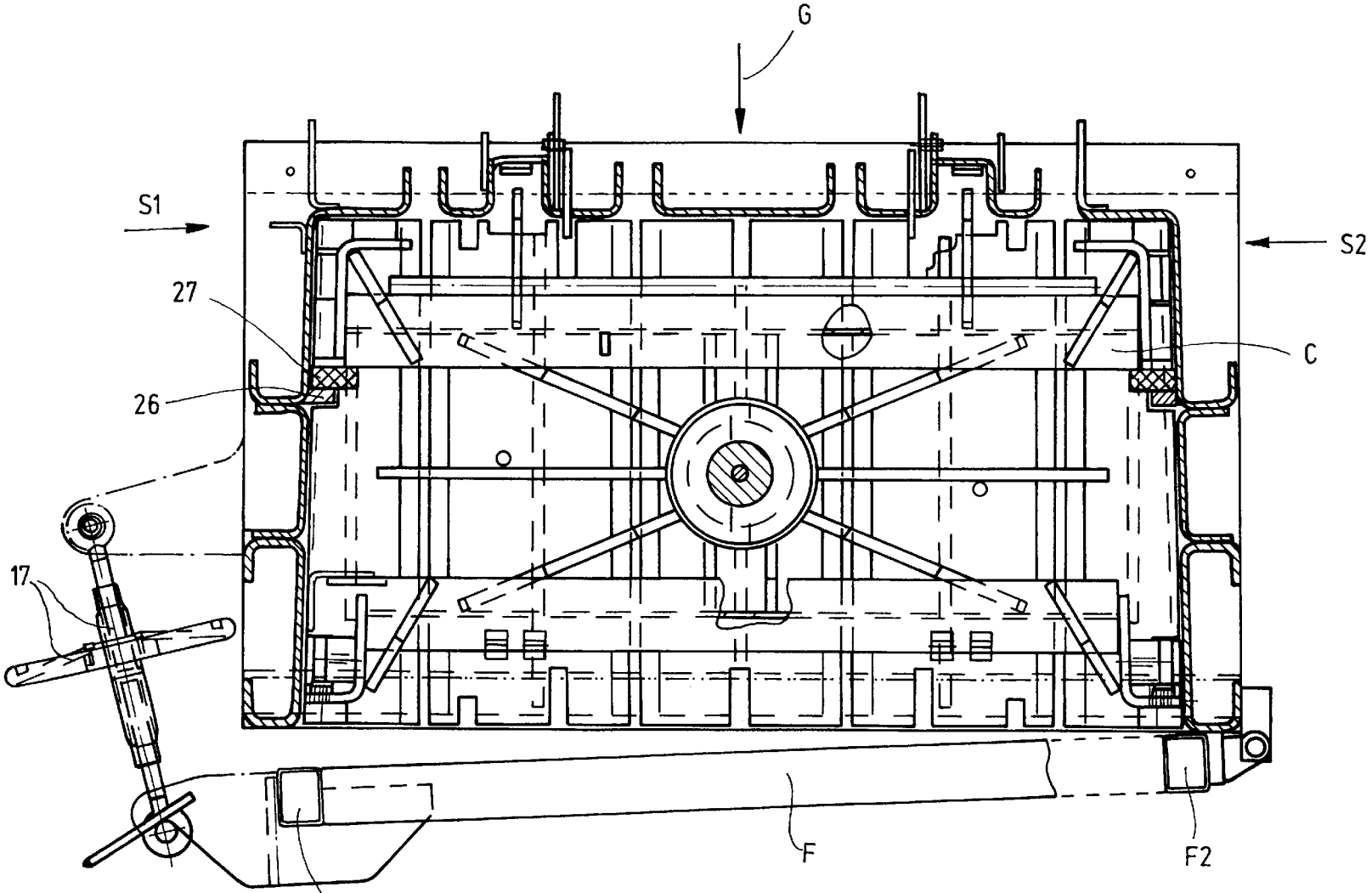
FIG. 11 is a top view into the shaft of the press of FIG. 7.

In accordance with another very essential feature of the present invention, an undesirable forward tilting of the pressing plate under the pulling action resulting from the ejection of the bale when the front door is opened, is now prevented for the first time by providing guide rails 26 on both sides at the inner walls S1 and S2 of the press shaft S and corresponding sliding blocks 27 on the pressing plate C, as shown in FIGS. 10 and 11. As a result, the pressing plate C supported with the front door F being closed at the lateral frame portions F1 of the door now also is securely guided in the direction toward the open front door when the front door is pivoted open for ejecting the finished bale.

While specific embodiments of the invention have been shown and described in detail to illustrate the inventive principles, it will be understood that the invention may be embodied otherwise without departing from such principles.

I claim:

1. A waste press with an ejection device for bales, the bale press comprising a press housing having a bottom floor and a rear wall and defining a shaft with a pressing area, at least one lifting plate mounted on or in the bottom floor and at least one pull rod connected in an articulated manner to the lifting plate and mounted on or in the rear wall, and a coupling member for at least temporarily connecting the pull rod and the pressing plate, the coupling member being configured for temporarily transmitting a movement of the pressing plate to the lifting plate and being comprised of a connecting unit mounted on an outer side of the rear wall of the press housing and configured to be forcibly swung in and out and to act temporarily on the pressing plate, the connecting unit protruding partially through a cutout of the rear wall, further comprising mechanically acting guide means at the rear wall of the press housing for controlling the connecting unit, wherein the connecting unit is permanently connected in an articulated manner to an upper end of the pull rod, and wherein an adjusting means actuated through a front door of the press housing is configured to act on the guide means of the connecting unit.

2. The waste press according to claim 1, wherein the connecting unit is mounted above the pressing area in a filling area of the shaft on the outside and partially in the rear wall, and wherein a guide track configured to act at least on portions of the connecting unit is mounted laterally of the cutout on the outer side of the rear wall, wherein the guide track extends obliquely outwardly in an upper track portion.

3. The waste press according to claim 1, wherein the connecting unit is comprised of at least one swivel piece connected in an articulated manner through a shaft to the pull rod, wherein a catch bolt and a pressure bolt are also connected to the swivel piece, a lower U-shaped guide member and an upper U-shaped guide member, wherein the upper and lower guide members are mounted in the area of the cutout through a shaft each in an articulated manner on the outer side of the rear wall, and wherein the upper and lower guide members together form a closed non-stationary guide means for the pressure bolt, and wherein the adjusting means are comprised of a spring-biased push rod guided in or on a side wall of the press housing and a strut connecting the push rod with the lower guide member.

4. The waste press according to claim 3, further comprising a damping element connected to the pressure bolt of the connecting unit, wherein the damping element is mounted to rest against the rear wall of the press housing.

5. The waste press according to claim 4, wherein the damping element is a gas pressure spring.

6. The waste press according to claim 1, comprising a safety switch, wherein the front door of the press housing rests against the safety switch when the front door is in a completely opened position.

7. The waste press according to claim 1, wherein the ejection device is comprised of a plurality of lifting plates and pull rods for each lifting plate, and connecting units arranged at cutouts of the rear wall, wherein the adjusting means are configured to act by a lever on a common shaft on which the lower guide members are fixedly arranged.

8. The waste press according to claim 1, wherein the pull rod has a lower end, the lower end having a nose extending horizontally and directed toward the lifting plate.

9. The waste press according to claim 1, wherein the mechanically acting guide means is comprised of a two-arm swing lever, and wherein the mechanically acting guide means are configured to be moved in and out through a coupling rod connected to the push rod and controlled by a transverse locking member and a rear wall stop means and guide tracks at the rear wall of the press housing.

10. The waste press according to claim 9, further comprising guide rails mounted at inner side walls of the press shaft and corresponding sliding blocks mounted on the pressing plate.

11. The waste press according to claim 10, wherein the guide rails are comprised of flat iron webs extending in a pressing direction and welded to the inner side walls, and wherein the guide rails are located in a rearward third portion of the shaft from the front door of the press housing.

* * * * *